US005815840A

United States Patent [19]

Hamlin

[11] Patent Number: 5,815,840

[45] Date of Patent: Oct. 6, 1998

[54] DETAILING GLOVE

[76] Inventor: John David Hamlin, P.O. Box 102, Killen, Ala. 35645

[21] Appl. No.: 833,829

[22] Filed: Apr. 10, 1997

[51] Int. Cl.[6] ..... A41D 19/00; A46B 5/04; A47L 13/10

[52] U.S. Cl. ..... 2/161.6; 2/161.8; 2/167; 2/164; 15/227

[58] Field of Search ..... 2/158, 159, 160, 2/160.1, 161, 162, 163, 164, 165, 166, 167, 168, 169, 161.1, 161.2, 161.3, 161.4, 161.5, 161.6, 161.7, 161.8, 21; 15/227

[56] References Cited

U.S. PATENT DOCUMENTS 3,643,386 2/1972 Grzyll ..... 2/161

4,545,841 10/1985 Jackrel ..... 2/159

*Primary Examiner*—Jeanette E. Chapman

[57] ABSTRACT

A new cleaning glove for cleaning and/or treating various surfaces, such as on vehicles. The inventive device includes a flexible hand covering member defining a pocket for receiving the hand of a user therein. The flexible hand covering member includes a plurality of finger portions, preferably five finger portions, for covering the fingers on the hand. The hand covering member also includes separate pile areas formed on a front surface thereof, while the back surface is substantially free of pile. The hand covering member is made from an inner cloth layer, a middle liquid-resistant layer, and an exterior cloth layer, and has a cut formed in the back side thereof in order to accommodate different hand sizes.

10 Claims, 2 Drawing Sheets

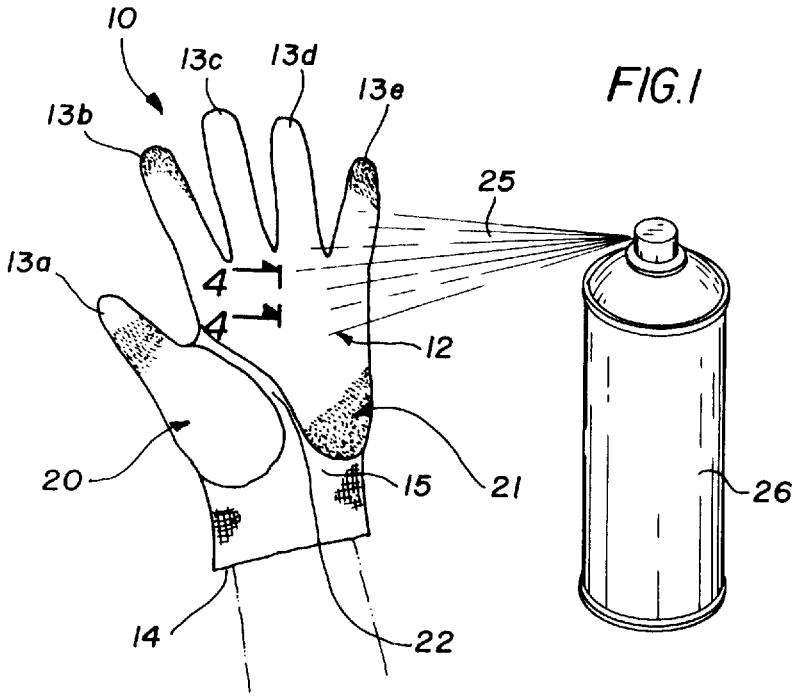
FIG.1
FIG.2
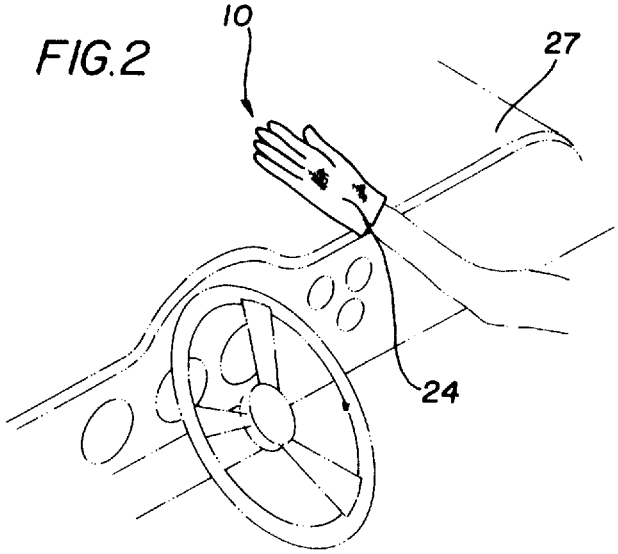

DETAILING GLOVE

BACKGROUND OF THE INVENTION

1. Field of the Invention

The present invention relates to cleaning devices and more particularly pertains to a new cleaning glove for cleaning or treating various surfaces, such as on vehicles.

2. Description of the Prior Art

The use of cleaning devices is known in the prior art. More specifically, cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning devices include U.S. Pat. No. 4,986,681; U.S. Pat. No. 4,696,593; U.S. Pat. No. 4,953,998; U.S. Pat. No. 4,953,250; U.S. Pat. No. 4,154,542; and U.S. Pat. No. 3,893,955.

While these devices fulfill their respective, particular objectives and requirements, the aforementioned patents do not disclose a new cleaning glove. The inventive device includes a flexible hand covering member defining a pocket for receiving the hand of a user therein. The flexible hand covering member includes a plurality of finger portions, preferably five finger portions, for covering the fingers on the hand. The hand covering member also includes separate pile areas formed on a front surface thereof, while the back surface is substantially free of pile. The hand covering member further includes an inner cloth layer, a middle liquid-resistant layer, and an exterior cloth layer, and a cut formed in the back side of the covering member in order to accommodate different hand sizes.

In these respects, the cleaning glove according to the present invention substantially departs from the conventional concepts and designs of the prior art, and in so doing provides an apparatus primarily developed for the purpose of cleaning and/or treating various surfaces, such as on vehicles.

SUMMARY OF THE INVENTION

In view of the foregoing disadvantages inherent in the known types of cleaning devices now present in the prior art, the present invention provides a new cleaning glove construction wherein the same can be utilized for cleaning and/or treating various surfaces, such as on vehicles.

The general purpose of the present invention, which will be described subsequently in greater detail, is to provide a new cleaning glove apparatus which has many of the advantages of the cleaning devices mentioned heretofore and many novel features that result in a new cleaning glove which is not anticipated, rendered obvious, suggested, or even implied by any of the prior art cleaning devices, either alone or in any combination thereof.

To attain this, the present invention generally comprises a flexible hand covering member defining a pocket for receiving the hand of a user therein. The flexible hand covering member includes a plurality of finger portions, preferably five finger portions, for covering the fingers on the hand. The hand covering member also includes separate pile areas formed on a front surface thereof, while the back surface is substantially free of pile. The hand covering member further includes an inner cloth layer, a middle liquid-resistant layer, and an exterior cloth layer, and a cut formed in the back side of the covering member in order to accommodate different hand sizes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning glove apparatus which has many of the advantages of the cleaning devices mentioned heretofore and many novel features that result in a new cleaning glove which is not anticipated, rendered obvious, suggested, or even implied by any of the prior art cleaning devices, either alone or in any combination thereof.

It is another object of the present invention to provide a new cleaning glove which may be easily and efficiently manufactured and marketed.

It is a further object of the present invention to provide a new cleaning glove which is of a durable and reliable construction.

An even further object of the present invention is to provide a new cleaning glove which is susceptible of a low cost of manufacture with regard to both materials and labor, and which accordingly is then susceptible of low prices of sale to the consuming public, thereby making such cleaning glove economically available to the buying public.

Still yet another object of the present invention is to provide a new cleaning glove which provides in the apparatuses and methods of the prior art some of the advantages thereof, while simultaneously overcoming some of the disadvantages normally associated therewith.

Still another object of the present invention is to provide a new cleaning glove for cleaning and/or treating various surfaces, such as on vehicles.

Yet another object of the present invention is to provide a new cleaning glove which includes a flexible hand covering member defining a pocket for receiving the hand of a user therein. The flexible hand covering member includes a plurality of finger portions, preferably five, for covering the fingers on the hand. The hand covering member also includes separate pile areas formed on a front surface thereof, while the back surface is substantially free of pile. The hand covering member further includes an inner cloth layer, a middle liquid-resistant layer, and an exterior cloth layer, and a cut formed in the back side of the covering member in order to accommodate different hand sizes.

Still yet another object of the present invention is to provide a new cleaning glove that makes it easier to clean/treat and access hard-to-reach areas of the vehicle.

Even still another object of the present invention is to provide a new cleaning glove that protects the users hands from harmful cleaning and treating agents.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new cleaning glove according to the present invention disposed on a users hand.

FIG. 2 shows the glove in use cleaning the interior of a vehicle.

DESCRIPTION OF THE PREFERRED EMBODIMENT

Figure 3:
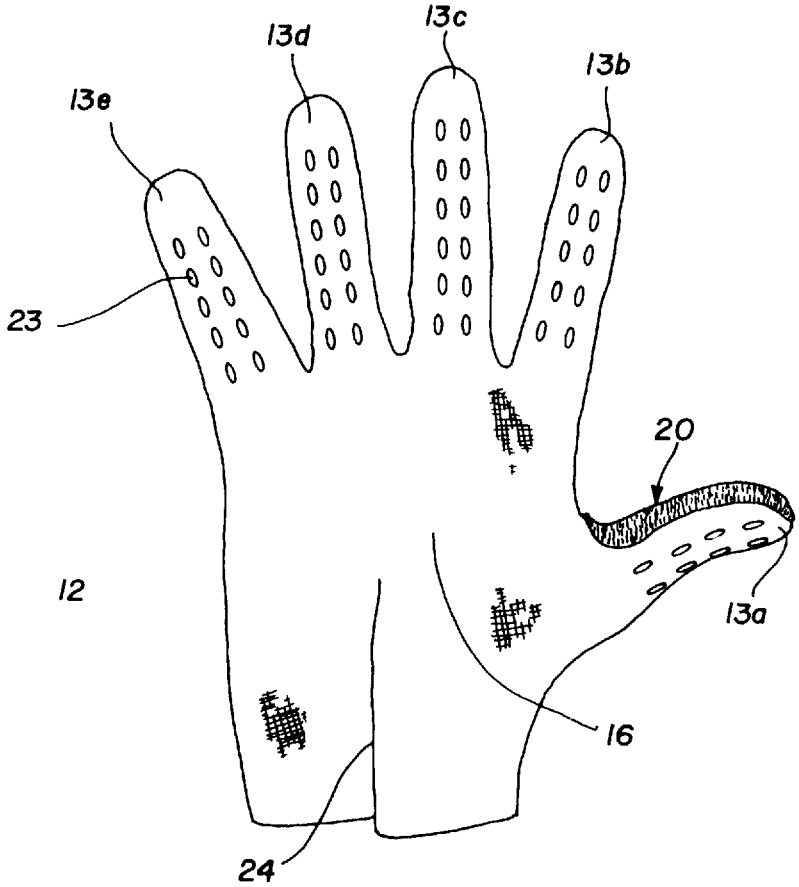
FIG. 3 is a view of the back side of the cleaning glove.

With reference now to the drawings, and in particular to FIGS. 1 through 4 thereof, a new cleaning glove embodying the principles and concepts of the present invention and generally designated by the reference numeral 10 will be described.

As best illustrated in FIGS. 1 through 4, the cleaning glove 10 comprises a flexible glove-like member designed to cover a persons hand and permit flexing and other movements of the fingers on the users hand. The glove 10 includes a main body portion 12 and a plurality of finger portions 13*a–e* connected to the main body portion. The finger portion 13*a* as shown herein is sized to receive the users thumb therein, with the portion 13*b* sized to receive the users index finger, and so on. Although the glove 10 is shown and described as having five finger portions, it should be realized that the glove can be made with a larger or smaller number of finger portions, depending upon the number of fingers on the users hand. In addition, the term finger as used throughout the description and claims is meant to include the thumb on the hand.

The main body portion 12 and the finger portions 13*a–e* define an inner pocket (not shown) which is sized to receive the persons hand therein. The main body portion 12 includes an opening 14 at the end opposite the finger portions 13*a–e* to permit entry of the hand into the glove 10. The glove 10 includes a front side which is generally meant to cover the palm area and the front surfaces of the fingers, and a back side which is generally meant to cover the back side of the hand. The front side generally defines a front surface 15 while the back side defines a back surface 16. The glove 10 is thus configured similar to conventional gloves.

Figure 4:
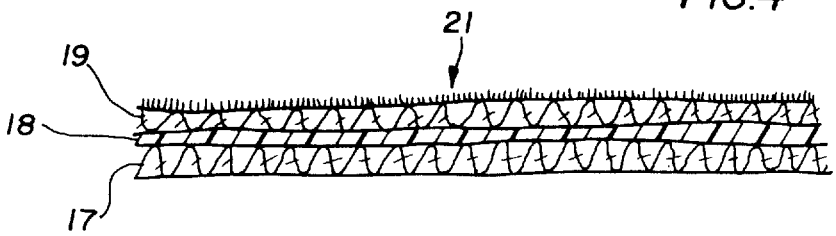
FIG. 4 is a cross sectional view taken along line 4—4 of FIG. 1.

As stated previously, the glove 10 is made to be flexible from suitable materials. Referring to FIG. 4, it is seen that the glove 10 includes an inner layer 17 made of any suitable cloth or cloth-like material, disposed adjacent the skin of the user's hand. A middle, liquid-resistant layer 18 of plastic, rubber, or the like material is suitably attached on one side to the layer 17, in order to prevent liquids from contacting the users hand. Exterior layer 19, made of a cloth or cloth-like material which can be the same as or different from the material of layer 17, is attached to the layer 18 and forms the exterior of the glove. The layer 19 is preferably made of a soft cotton or polyester material, in order to prevent marring of a surface which is being cleaned or polished.

The front surface 15 of the glove, as best seen in FIG. 1, is provided with a first pile area 20 and a second pile area 21 separated from the first pile area 20 by an unpiled area 22. The pile areas 20, 21 comprise areas where the material forming the layer 19 is raised forming fuzzy surface areas. The pile area 20 generally encompasses the front surface 15 of the finger portion 13*a* and the base area thereof, while the pile area 21 generally encompasses the majority of the front surface of the main body portion 12 and the front surfaces of the finger portions 13*b–e*. The unpiled area 22 is surface of the exterior layer 19 which is not piled. The back surface 16 of the glove 10 is substantially free of pile areas.

The pile in the areas 20, 21 improve the cleaning effectiveness of the glove 10 by increasing the surface area which is available to gather dust, dirt, and the like, when the glove is wiped on the surface to be cleaned. The pile also reaches into surface imperfections to improve the cleaning and/or treating of the surface. The individual finger portions 13*a–e* permit the user to utilize his/her fingers to access hard to reach surface areas to be cleaned. For instance, the glove 10 permits a single finger to be used to clean a small gap, crack, or the like, and since each finger portion 13*a–e* has pile formed thereon, the hard to reach area is effectively cleaned.

Referring now to FIG. 3, it is seen that the back side of the finger portions 13*a–e* on the glove are provided with vent holes 23 which extend through the three layers 17–19 to the back surface 16. The vent holes 23 permit air circulation to, and from, the users fingers within the finger portions, thus cooling the fingers. Although the vent holes 23 are illustrated as being only on the finger portions, the back side of the main body portion 12 could also be provided with vent holes in order to further cool the users hand.

Also shown in FIG. 3 is an expansion cut 24 formed through the three layers 17–19 on the back side of the glove, in order to permit larger sized hands to fit within the glove. The cut 24 extends from the open end of the glove to approximately the middle of the main body portion 12.

In use, and referring to FIGS. 1 and 2, the glove is first disposed on the users hand. A treating agent 25, such as a spray type of agent like a vinyl protectant provided in a suitable container 26, is applied to the front side of the glove, and in particular to the pile areas 20, 21. The glove is then wiped over the surface to be cleaned or treated, such as the dashboard 27 of a vehicle. The individual finger portions 13*a–e* can be used to wipe small, or hard to reach, areas, and allow increased control by the user during the cleaning/treating process. The liquid resistant layer 18 prevents the agent 25 from coming into contact with the skin on the users hand, thus protecting the skin from any potential harmful effects of the agent.

Although the glove is described and shown herein as being used on vehicles, the glove could also be used in households to clean or treat items such as furniture, decorations, mini-blinds, and the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning glove, comprising:

a flexible hand covering member defining an inner pocket adapted to receive a hand of a user therein, said flexible member including a plurality of finger portions thereon to each cover a finger on the users hand and said flexible member defining a front side having a front surface and a back side having a back surface; and pile formed on at least a portion of said front surface, and said back surface being substantially free of pile;

said hand covering member having at least five of said finger portions so that each finger on the users hand is separately covered; and wherein said flexible hand covering member comprises an inner cloth layer, a middle liquid-resistant layer attached to the inner cloth layer, and an exterior cloth layer attached to the middle layer.

2. The cleaning glove of claim 1, wherein said flexible hand covering member includes expansion means for permitting different sized hands to fit within the inner pocket.

3. The cleaning glove of claim 2, wherein said expansion means comprises a slit formed on the back side of the hand covering member, said slit extending through the back surface thereof.

4. The cleaning glove of claim 3, further comprising a plurality of vent holes formed in said plurality of finger portions, said plurality of vent holes being positioned on the back side of the flexible hand covering member.

5. The cleaning glove of claim 1, wherein said pile comprises a first pile area and a second pile area formed on the front surface, said first pile area and said second pile area being separated from each other by an unpiled area on the front surface.

6. The cleaning glove of claim 5, wherein said first pile area is formed on one of said plurality of finger portions, and said second pile area is formed on at least one of the remaining said plurality of finger portions.

7. A cleaning glove, comprising:

a flexible hand covering member defining an inner pocket adapted to receive a hand of a user therein, said flexible member including a plurality of finger portions thereon to each cover a finger on the users hand and said flexible member defining a front side having a front surface and a back side having a back surface;

pile formed on at least a portion of said front surface, and said back surface being substantially free of pile;

said hand covering member having at least five of said finger portions so that each finger on the users hand is separately covered;

wherein said flexible hand covering member comprises an inner cloth layer, a middle liquid-resistant layer attached to the inner cloth layer, and an exterior cloth layer attached to the middle layer;

wherein said middle liquid resistant layer is constructed of a liquid resistant material chosen from the group of liquid resistant materials consisting of plastic and rubber;

wherein said flexible hand covering member includes expansion means for permitting different sized hands to fit within the inner pocket;

wherein said expansion means comprises a cut formed on the back side of the hand covering member extending through the back surface thereof;

a plurality of vent holes formed in said plurality of finger portions on the back side of the flexible hand covering member; and wherein said pile comprises a first pile area and a second pile area formed on the front surface, said first pile area and said second pile area being separated from each other by an unpiled area on the front surface.

8. The cleaning glove of claim 9, wherein said first pile area is formed on one of said plurality of finger portions, and said second pile area is formed on at least one of the remaining said plurality of finger portions.

9. A method of applying a substance to an interior surface of a vehicle, said method comprising the steps of:

providing a glove comprising a flexible hand covering member defining an inner pocket adapted to receive a hand of a user therein, said flexible member including a plurality of finger portions thereon to each cover a finger on the users hand and said flexible member defining a front side having a front surface and a back side having a back surface, said glove having pile formed on at least a portion of said front surface, and said back surface being substantially free of pile, said hand covering member having at least five of said finger portions so that each finger on the users hand is separately covered, wherein said flexible hand covering member comprises an inner cloth layer, a middle liquid-resistant layer attached to the inner cloth layer, and an exterior cloth layer attached to the middle layer, wherein said middle liquid resistant layer is constructed of a liquid resistant material chosen from the group of liquid resistant materials consisting of plastic and rubber, wherein said flexible hand covering member includes expansion means for permitting different sized hands to fit within the inner pocket, wherein said expansion means comprises a cut formed on the back side of the hand covering member extending through the back surface thereof, a plurality of vent holes formed in said plurality of finger portions on the back side of the flexible hand covering member, and wherein said pile comprises a first pile area and a second pile area formed on the front surface, said first pile area and said second pile area being separated from each other by an unpiled area on the front surface;

applying a substance to at least one of said pile portions on said front surface of said glove; and touching the glove to the interior surfaces of a vehicle such that an amount of said substance absorbed by said pile is transferred to said interior surfaces.

10. The method of claim 9 wherein the step of applying a substance to at least one of said pile portions on said front surface of said glove includes spraying a cleaning fluid onto at least one of said pile portions.

* * * * *